US006166588A

United States Patent [19]

Miyawaki

[11] Patent Number: 6,166,588

[45] Date of Patent: Dec. 26, 2000

[54] POWER SUPPLY CIRCUIT

[75] Inventor: Masahumi Miyawaki, Tokyo, Japan

[73] Assignee: Oki Electric Industry Co., Ltd., Tokyo, Japan

[21] Appl. No.: 09/213,420

[22] Filed: Dec. 17, 1998

[30] Foreign Application Priority Data

Jan. 7, 1998 [JP] Japan ..... 10-001282

[51] Int. Cl.[7] ..... G05F 3/02

[52] U.S. Cl. ..... 327/540; 327/541; 327/143

[58] Field of Search ..... 327/530, 538, 327/540, 541, 143; 323/315; 361/91

[56] References Cited

U.S. PATENT DOCUMENTS 6,008,747 12/1999 Iida ..... 341/135

6,023,157 12/1999 Kazuno ..... 323/312

*Primary Examiner*—Tuan T. Lam

*Assistant Examiner*—Hiep Nguyen

*Attorney, Agent, or Firm*—Rabin & Champagne, PC

[57] ABSTRACT

A power supply circuit comprising a reference voltage generating circuit and an internal voltage generating circuit, whereby a stable internal voltage can be supplied. The reference voltage generating circuit comprises a resistor, of which one end is coupled to a power supply terminal, and a first NMOSFET, of which the drain electrode is coupled to the other end of the resistor, the source electrode is coupled to an earth terminal, and the gate electrode is coupled to the drain electrode. The internal voltage generating circuit comprises a second NMOSFET, of which the gate electrode is coupled to the drain electrode of the first NMOSFET and the source electrode is coupled to the earth terminal, and a constant voltage generating circuit, coupled between the drain electrode of the second NMOSFET and the power supply terminal, which outputs a constant voltage. The gate length of the first NMOSFET is formed longer than the gate length of the second NMOSFET.

12 Claims, 4 Drawing Sheets

CONVENTIONAL ART

POWER SUPPLY CIRCUIT

BACKGROUND OF THE INVENTION

1. Field of the Invention

The present invention relates to a power supply circuit, and more particularly, to a power supply circuit comprising a reference voltage generating circuit and an internal voltage generating circuit.

2. Description of Related Art

Conventionally, a power supply circuit for a semiconductor device, such as a memory, is constituted by a circuit as illustrated in FIG. 4. FIG. 4 is a circuit diagram schematically showing the composition of a power supply circuit. Referring to FIG. 4, a power supply circuit 10 principally comprises a reference voltage generating circuit 11 and an internal voltage generating circuit 13.

The reference voltage generating circuit 11 comprises a resistor R, one end 15 of which is coupled to a power supply terminal Vcc, and a first N-type field effect transistor (NMOSFET) (Tr1), of which the drain electrode 19 is coupled to the other end 17 of the resistor R, the source electrode 21 is coupled to an earth terminal Vss, and the gate electrode 23 is coupled to the drain electrode 19.

Furthermore, the internal voltage generating circuit 13 comprises a second NMOSFET (Tr2), of which the gate electrode 25 is coupled to the drain electrode 19 of the first NMOSFET (Tr1) and the source electrode 27 is coupled to an earth or ground terminal Vss, and a constant voltage generating circuit 31, which outputs a constant voltage, coupled between the drain electrode 29 of the second NMOSFET (Tr2) and a power supply terminal Vcc (FIG. 4).

The output voltage (internal voltage) taken from the output terminal 33 of the constant voltage generating circuit 31 forms a power voltage for driving later stage circuits which are connected to the internal voltage generating circuit 13.

In this power supply circuit 10, the voltage between the power supply terminal Vcc and the earth terminal Vss is divided by the resistor R and the first NMOSFET (Tr1), and this divided voltage forms an output of the reference voltage generating circuit 11 (called a reference voltage). An output point is the connection point N between the gate electrode 23 and drain electrode 19 of the first NMOSFET (Tr1). Moreover, the resistance value R is set such that the voltage between the connection point N and the earth terminal Vss is substantially the same as, or slightly higher than, the threshold voltage of the first NMOSFET (Tr1). Furthermore, the first and second NMOSFETs (Tr1 and Tr2) are transistors which are manufactured under the same conditions and have the same effective composition and operation. Therefore, the threshold voltage of the first NMOSFET (Tr1) and the threshold voltage of the second NMOSFET (Tr2) have effectively the same value.

Next, the operation of the power supply circuit 10 is described.

Firstly, in the reference voltage generating circuit 11, the divided voltage obtained by the resistor R and the first NMOSFET (Tr1) is applied constantly to the gate electrode 23 of the first NMOSFET (Tr1). Since this voltage has a value equal to or higher than the threshold voltage of the first NMOSFET (Tr1), the first NMOSFET (Tr1) is constantly switched on. Even if there is a change in the voltage of the power supply terminal Vcc, a constant reference voltage signal is output from output point N. The reference voltage signal from the output point N is applied to the gate electrode 25 of the second NMOSFET (Tr2) of the internal voltage generating circuit 13. Since the reference voltage applied to the gate electrode 25 of the second NMOSFET (Tr2) is equal to or higher than the threshold voltage of the second NMOSFET (Tr2), the second NMOSFET (Tr2) is switched on (an ON state), and the constant voltage generating circuit 31 coupled between the drain electrode 29 of the second NMOSFET (Tr2) and power supply terminal Vcc is driven. The constant voltage generating circuit 31 is driven when the second NMOSFET (Tr2) is switched on. Therefore, the output signal from the constant voltage generating circuit 31 can be outputted as an internal voltage signal.

The first and second NMOSFETs (Tr1 and Tr2) of the power supply circuit described above are transistors which are formed by the same process and have substantially the same composition and operation.

With the miniaturization of semiconductor devices in recent years, transistor gate lengths have been becoming shorter. Usually, the gate length in a transistor used in a generic memory is approximately 2–3 $\mu$m. If the first and second NMOSFETs (Tr1 and Tr2) are manufactured by the same process, then there is a risk that the threshold voltage of the second NMOSFET (Tr2) will be higher than the threshold voltage of the first NMOSFET (Tr1), due to variations during the manufacturing process. If the threshold voltage of the first NMOSFET (Tr1) is indeedhigher than the threshold voltage of the second NMOSFET (Tr2), then the voltage input from the reference voltage circuit 11 to the gate electrode 25 of the second NMOSFET (Tr2) in the internal voltage generating circuit 13, in other words, the reference voltage, which is set to virtually the same level as the threshold voltage of the first NMOSFET (Tr1), will ultimately have a lower value than the threshold voltage of second NMOSFET (Tr2). Therefore, even if the reference voltage is applied to the gate electrode 25 of the second NMOSFET (Tr2), the second NMOSFET (Tr2) will not switch on and the constant voltage generating circuit 31 will not be driven. Consequently, a problem arises in that a stable internal voltage cannot be obtained.

Therefore, one method conceived for switching on the second NMOSFET (Tr2) involves setting the voltage between the output point N and earth terminal Vss to a higher value than the threshold voltage of the first NMOSFET (Tr1) by lowering the resistance value of the resistor R. However, if this method is adopted, the power consumption by the reference voltage generating circuit 11 will become greater than in the prior art (first problem).

Accordingly, the development of a power supply circuit for miniaturized semiconductor devices, whereby a stable internal voltage is obtained without increasing the power consumption of the reference voltage generating circuit, has been awaited.

Moreover, in the circuit connected after the power supply circuit 10 (hereinafter, called the later or second stage circuit), if the output from the power supply circuit 10 is used as the power supply voltage of the second stage circuit, then the output voltage (internal voltage) from the power supply circuit 10 is applied constantly to the second stage circuit. This state is then taken as the standby state of the second stage circuit. To drive the second stage circuit, an active signal is applied to the second stage circuit and when this active signal is applied, the second stage circuit is driven and a large current flows through the second stage circuit.

Furthermore, the earth terminal of the second stage circuit is connected to the earth terminal Vss. Therefore, if a large current flows in the second stage circuit whilst it is being driven, the electric potential of the earth terminal Vss will increase and there is a possibility that the threshold voltage of the second NMOSFET (Tr2) in the internal voltage generating circuit of the power supply circuit will rise temporarily. Consequently, a problem may arise in that the second NMOSFET (Tr2) will not switch on even if the reference voltage is applied to the gate electrode 25 of the second NMOSFET (Tr2), and hence a stable internal voltage cannot be obtained (second problem).

Therefore, the development of a power supply circuit whereby a stable internal voltage is supplied, even when the second stage circuit using the output of the power supply circuit as a power supply voltage is driven, has been awaited.

SUMMARY OF THE INVENTION

It is an object of the present invention to provide a power supply circuit for a semiconductor device, which is capable of supplying a stable internal voltage.

Therefore, according to a first aspect of the present invention, there is provided a power supply circuit comprising a reference voltage generating circuit and an internal voltage generating circuit having the following composition. Namely, the reference voltage generating circuit comprises: a resistor, of which one end is coupled to a power supply terminal; and a first NMOSFET, of which a drain electrode is coupled to the other end of the resistor, a source electrode is coupled to an earth (or ground) terminal, and a gate electrode is coupled to the drain electrode. The internal voltage generating circuit comprises: a second NMOSFET, of which a gate electrode is coupled to the drain electrode of the first NMOSFET and a source electrode is coupled to the earth (or ground) terminal; and a constant voltage generating circuit for outputting a constant voltage, coupled between the drain electrode of the second NMOSFET and the power supply terminal. In this invention, the gate length of the first NMOSFET is longer than the gate length of the second NMOSFET.

A longer gate length means that that transistor will have a higher threshold voltage. Therefore, it is possible to set the threshold voltage of the first NMOSFET higher than the threshold voltage of the second NMOSFET. Since the threshold voltage of the first NMOSFET is set higher than the threshold voltage of the second NMOSFET in advance, then it is possible to drive the second NMOSFET at all times, even if there are manufacturing variations, and therefore a stable internal voltage can be supplied.

Moreover, preferably, the first and second NMOSFETs may be elements which are fabricated by the same manufacturing process.

By using the same process to manufacture the first and second NMOSFETs, which have the same composition and operation, apart from their gate length, it is possible to manufacture them under the same conditions. Therefore, fluctuation in properties between the two elements (first and second NMOSFETs) can be restricted to a minimum. Furthermore, the time required for manufacture can also be shortened.

Furthermore, preferably, the gate length of the first NMOSFET may be formed 0.1 $\mu$m or more longer than the gate length of the second NMOSFET.

If the gate lengths of the first and second NMOSFETs are set to 2–3 $\mu$m and their other conditions are set to the same conditions during manufacture, then there is a risk that if the gate length of the second NMOSFET is 0.1 $\mu$m or more longer than the gate length of the first NMOSFET, it will become impossible to supply a stable internal voltage. Therefore, provided that the gate length of the first NMOSFET is set in advance to 0.1 $\mu$m or more longer than the gate length of the second NMOSFET, it will be possible to supply a stable internal voltage at all times, even if there are variations in manufacture.

According to a second aspect of the present invention, there is provided a power supply circuit comprising a reference voltage generating circuit and an internal voltage generating circuit having the following composition. The reference voltage generating circuit comprises: a first resistor, of which one end is coupled to a power supply terminal; and a first NMOSFET, of which a drain electrode is coupled to the other end of the first resistor, a source electrode is coupled to an earth (or ground) terminal, and a gate electrode is coupled to the drain electrode. The internal voltage generating circuit comprises: a second NMOSFET, of which a gate electrode is coupled to the drain electrode of the first NMOSFET, and a source electrode is coupled to the earth terminal; and a constant voltage generating circuit for outputting a constant voltage, coupled between the drain electrode of the second NMOSFET and the power supply terminal. In this invention, the constant voltage is an output voltage supplied as a power supply voltage to second (or later) stage circuits driven by an active signal. Moreover, the constant voltage generating circuit is provided with a reference voltage raising circuit comprising: a second resistor, of which one end is coupled to the power supply terminal; and an electronic switch, coupled between the other end of the second resistor and the drain electrode of the first NMOSFET, which is opened and closed by the active signal.

The electronic switch of the reference voltage raising circuit is switched on by the active signal for driving the second stage circuit connected to the power supply circuit. Thereby, the voltage between voltage terminal Vcc and earth terminal Vss is divided by the composite resistor, comprising the first resistor of the reference voltage generating circuit and the second resistor of the reference voltage generating circuit connected mutually in parallel, and by the first NMOSFET. Since the value of the composite resistor of the first resistor and the second resistor is less than the value of first resistor alone, the voltage obtained by dividing is higher than the threshold voltage of the first NMOSFET. This voltage is output as a reference voltage. Consequently, when the active signal is input, a higher voltage than the threshold voltage of the first NMOSFET is output as a reference voltage, and when no active signal is input, a voltage of virtually the same level as the threshold voltage of the first NMOSFET is output. Therefore, since it is possible to make the reference voltage higher than the threshold voltage of the first NMOSFET when the second stage circuit after the power supply circuit is driven, then even if the threshold voltage of the second NMOSFET rises temporarily, a voltage higher than this threshold voltage will still be applied to the gate electrode of the second NMOSFET, and hence a stable internal voltage can be obtained at all times. Furthermore, since the reference voltage is not in a high state continuously, there is no risk of the power consumption of the reference voltage circuit increasing considerably.

Moreover, preferably, the first and second MOSFETs may be elements fabricated by the same manufacturing process.

Furthermore, in the power supply circuit, preferably, the gate length of the first NMOSFET may be formed longer than the gate length of the second NMOSFET.

Thereby, since a voltage above the threshold voltage of the second NMOSFET is applied to the gate electrode of the second NMOSFET at all times, it is possible to supply a stable internal voltage. Moreover, when a circuit carrying a large current and provided as a second (or later) stage to the power supply circuit is driven, the reference voltage applied to the gate electrode of the second NMOSFET can be raised temporarily when this circuit is driven, and therefore the second NMOSFET will be switched on even if there is a rise in the threshold voltage of the second NMOSFET during this driving operation. Consequently, it is possible to supply a stable internal voltage.

Preferably, the electronic switch in the reference voltage raising circuit maybe a transistor. If this transistor is, for example, a bipolar transistor, then it should be set such that it actuates when an active signal is input to the base. Furthermore, if the transistor is a unipolar transistor, then it should be constructed such that it actuates when an active signal is input to the gate.

Also, the injection dose of impurity ions to the channel section of the first NMOSFET is greater than the injection dose of impurity ions to the channel section of the second NMOSFET. Thereby, the threshold voltage of the first NMOSFET can be raised above the threshold voltage of the second NMOSFET. Therefore, it is considered that a stable internal voltage can be obtained by this means also.

BRIEF DESCRIPTION OF THE DRAWINGS

The foregoing and other objects, features and advantages of the present invention will be better understood from the following description taken along in connection with the accompanying drawings, in which.

DESCRIPTION OF THE PREFERRED EMBODIMENTS

With reference to the drawings, embodiments of the present invention will be described hereinbelow. Each diagram gives no more than a schematic illustration in order that the present invention can be understood, and therefore the invention is not limited to the illustrated examples.

First Embodiment

A first embodiment of this invention is now described with reference to FIG. 4, using as an example a power supply circuit comprising a reference voltage generating circuit and an internal voltage generating circuit.

Figure 4:
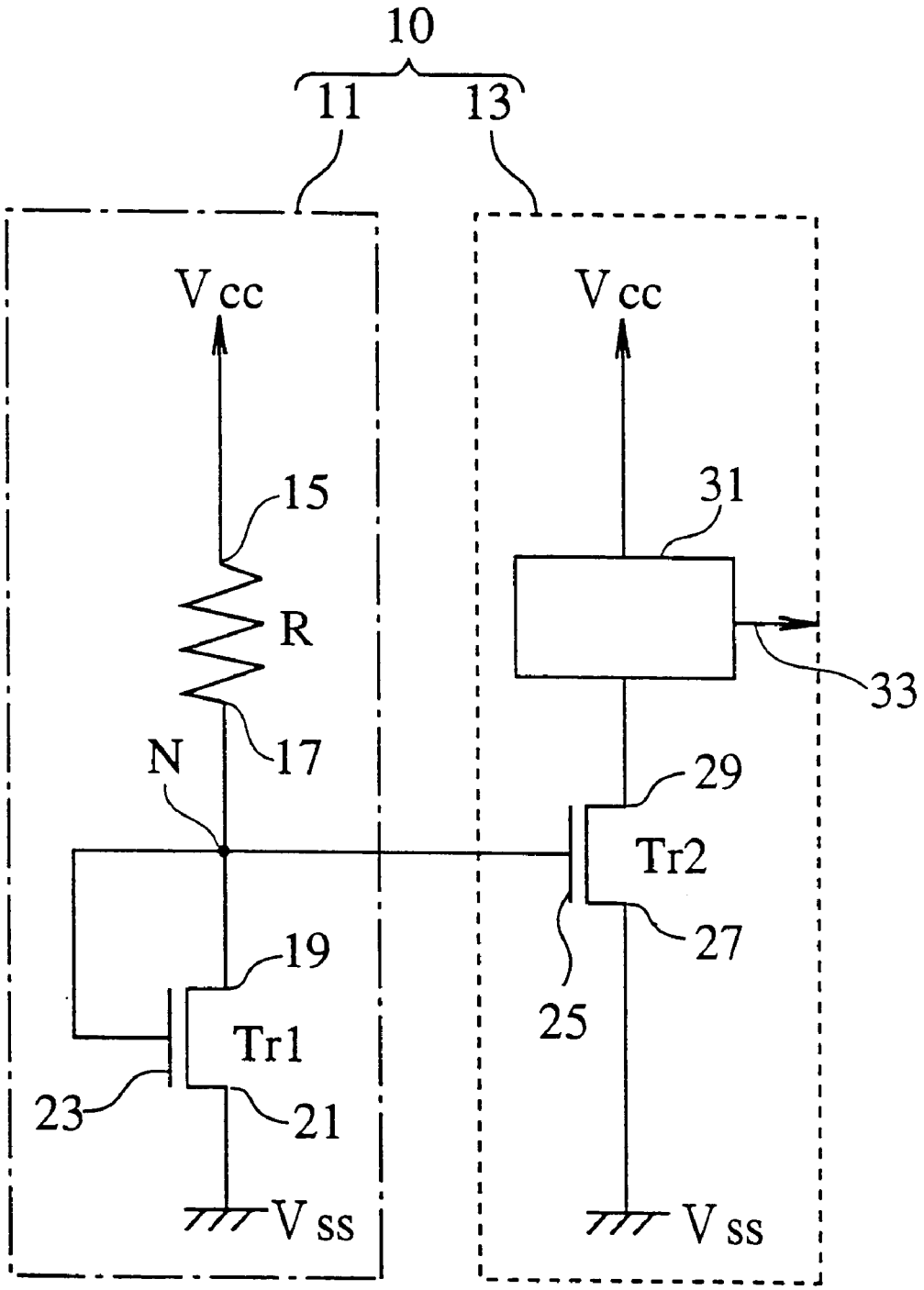
FIG. 4 is a circuit diagram for explaining a conventional power supply circuit and a power supply circuit according to a second embodiment of the present invention.

FIG. 4 is a schematic circuit diagram for explaining a description of a power supply circuit according to this invention. The construction itself is similar to a conventional power supply circuit comprising a reference voltage generating circuit and an internal voltage generating circuit. Therefore, since the circuit construction has already been described, it is explained only briefly here.

The reference voltage generating circuit 11 comprises a resistor R, of which one end is coupled to a power supply terminal Vcc, and a first NMOSFET (Tr1). In NMOSFET Tr1, the drain electrode 19 is coupled to the other end 17 of the resistor R, the source electrode 21 is coupled to an earth (or ground) terminal Vss, and the gate electrode 23 is coupled to the drain electrode 19.

The internal voltage generating circuit 13 comprises a second NMOSFET (Tr2), of which the gate electrode 25 is coupled to the drain electrode 19 of the first NMOSFET (Tr1) and the source electrode 27 is coupled to the earth terminal Vss, and a constant voltage generating circuit 31 for outputting a constant voltage, coupled between the drain electrode 29 of the second NMOSFET (Tr2) and the power supply terminal Vcc.

The constant voltage output from the constant voltage generating circuit 31 is the output voltage from the internal voltage generating circuit 13, and it is used as the power supply voltage for second stage circuits.

In the power supply circuit 10, the voltage between the power supply terminal Vcc and earth terminal Vss is divided by the resistor R and the first NMOSFET (Tr1), and this divided voltage forms the output of the reference voltage generating circuit 11. In other words, this output voltage is the reference voltage. An output point is formed by the connection point N between the gate electrode 23 of the first NMOSFET (Tr1) and the drain electrode 19. Furthermore, the resistor R is set such that the voltage between the connection point N and the earth terminal Vss is substantially the same or slightly higher than the threshold voltage of the first NMOSFET (Tr1).

The reference voltage output from the reference voltage generating circuit 11 is applied to the gate electrode 25 of the second NMOSFET (Tr2) in the internal voltage generating circuit 13, and the second NMOSFET (Tr2) is switched on. Thereby, the constant voltage generating circuit 31 is switched on and an internal voltage is output.

Furthermore, the first and second NMOSFETs (Tr1 and Tr2) in this power supply circuit 10 are elements fabricated by the same manufacturing process. The manufacturing process for the NMOSFETs is the same as a standard manufacturing process.

The manufacturing process is now described briefly with reference to FIG. 1 and FIG. 2. FIG. 1 and FIG. 2 are sectional process diagram giving a schematic illustration of the manufacturing process for an NMOSFET. Firstly, a thin thermal oxide film ($SiO_2$ film) 43 is formed onto the surface of a p-type Si substrate 41, for example, and a $Si_3N_4$ film 45 is then formed on the oxide film 43 (FIG. 1(A)).

Figure 1A:
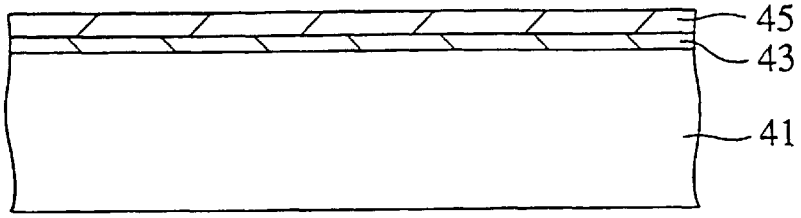
FIG. 1 is a diagram schematically showing a manufacturing process for an NMOSFET and for explaining a first embodiment of a power supply circuit according to this invention.
Figure 1B:
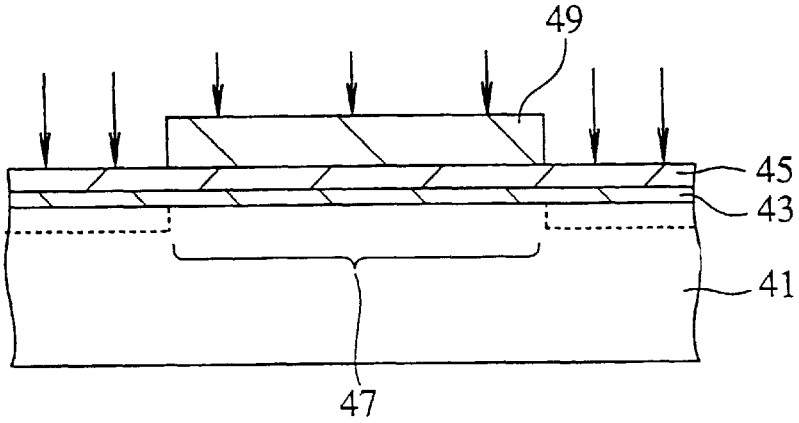

Thereupon, after the regions 47 where the FETs are to be fabricated (active regions) have been protected respectively by photoresist 49, B (boron) ion injection is carried out through the $SiO_2/Si_3N_4$ film (43/45) as a channel prevention layer (FIG. 1(B)).

The portion of the $Si_3N_4$ film 45 not protected by the photoresist 49 is then removed by etching. After this etching, the photoresist 49 is also removed. After this, the resulting structure is subjected to thermal oxidation in an oxidizing furnace. Then, an oxide film 51 grows in the portions where the $Si_3N_4$ has been removed. Then, after the remaining $SiO_2/Si_3N_4$ film (43/45) has been removed, thermal oxidation is carried out to form a thin gate oxide film 53. The threshold voltage is then adjusted by injecting B ions from the top of the gate oxide film 53 (FIG. 1(C)).

Figure 1C:
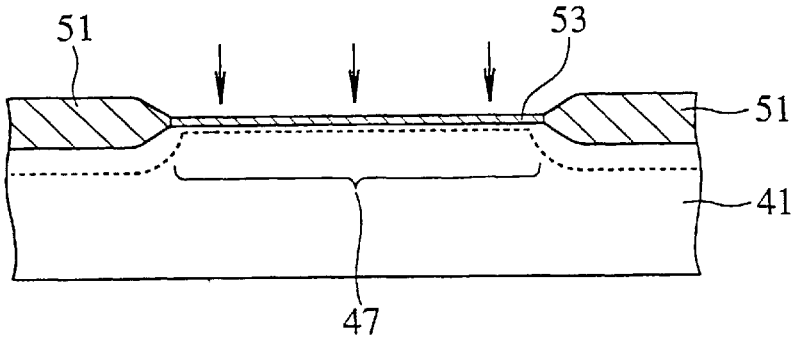
Figure 1D:
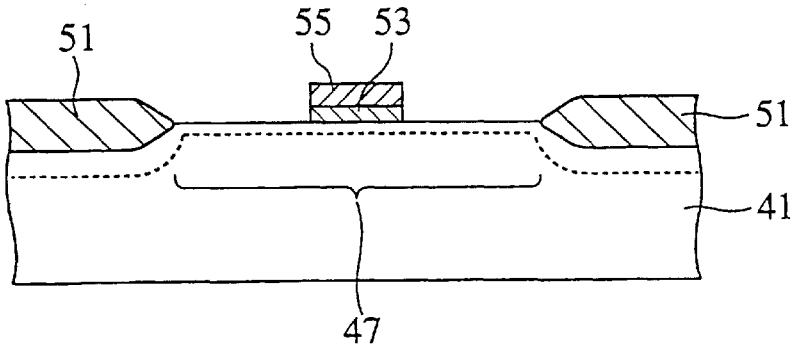

Next, after providing a polysilicate film on the gate oxide film 53, a gate 55 is formed by patterning of the polysilicate film and the gate oxide film 53 (FIG. 1(D)).

Figure 2A:
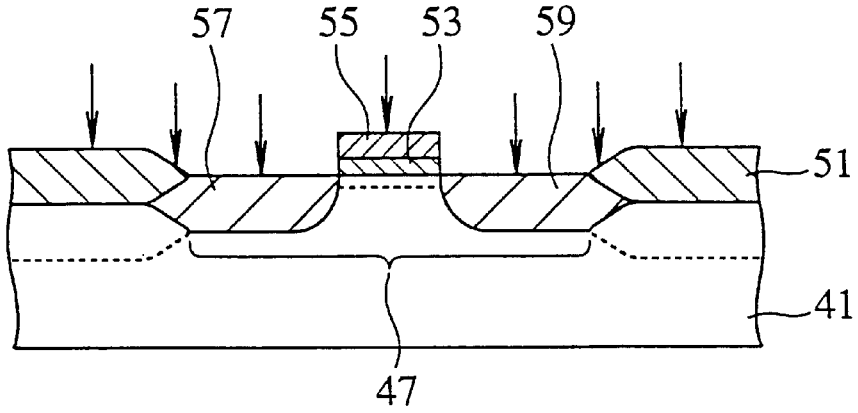
FIG. 2 is a diagram schematically showing a manufacturing process for an NMOSFET, continuing on from FIG. 1.
Figure 2B:
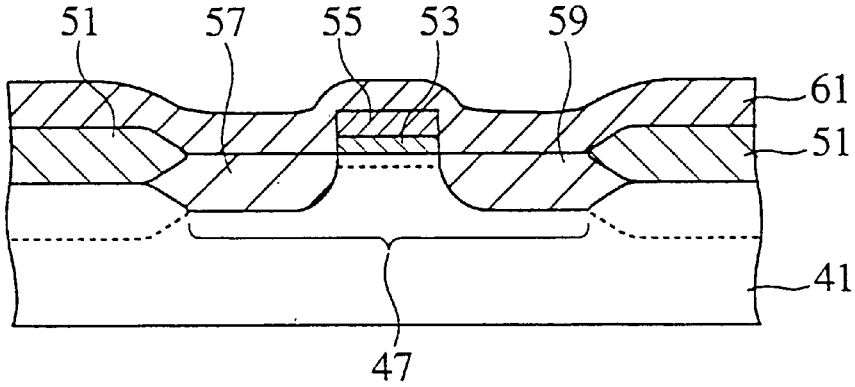
Figure 2C:
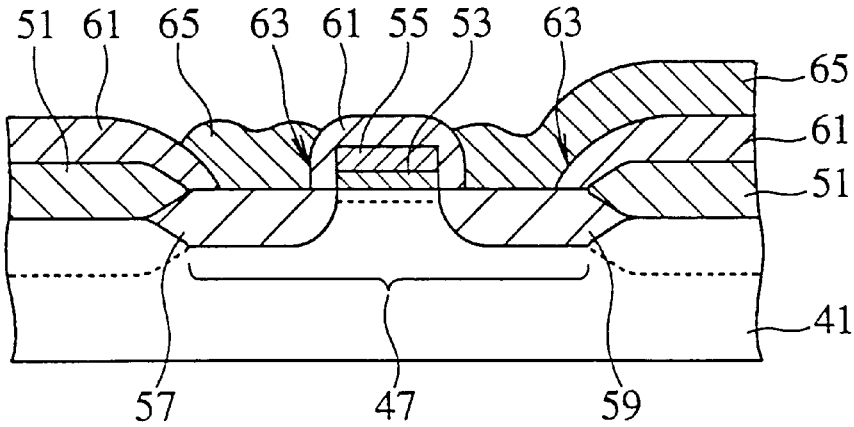

After this, using the gate 55 as a mask, As ions, for example, are injected into the Si substrate 41, thereby forming a source region 57 and a drain region 59 (FIG. 2(A)).

Next, a p-glass 61 is provided after the whole surface and heat treatment is applied. For this p-glass 61, PSG (Phospho-Silicate Glass) or BPSG (Boro-Phospho-Silicate Glass) can be used. A flat surface is formed thereby (FIG. 2(B)).

In order to form electrodes to the source region 57 and drain region 59, a window 63 is formed through the p-glass 61. A metal film 65 is formed in the window 63 such that electrical connection is made respectively to the source region 57 and the drain region 59 (FIG. 2(C)).

Furthermore, an electrode to the gate is applied outside the active region, so that the thin gate oxide film is not damaged (omitted from drawing).

In this process for manufacturing the NMOSFETs, when forming the gate 55, the gate length of the first NMOSFET (Tr1) is formed longer than the gate length of the second NMOSFET (Tr2). Thereby, it is possible to set the threshold voltage of the first NMOSFET (Tr1) higher than the threshold voltage of the second NMOSFET (Tr2). Consequently, even if there is some variation in transistor manufacture, it is possible to prevent these manufacturing variations from affecting the activation of the second NMOSFET (Tr2). Therefore, it is possible to supply a stable internal voltage at all times.

In this embodiment, the respective gate lengths of the first and second NMOSFETs (Tr1 and Tr2) are set to 2–3 $\mu$m. The gate length of the first NMOSFET (Tr1) is formed 0.1 $\mu$m, for example, longer than the gate length of the second NMOSFET, whilst not exceeding 3 $\mu$m in length.

Moreover, in the transistor manufacture process, as shown in FIG. 1(C), in the process for adjusting the threshold value by injection of B ions, for example, into the channel region, after formation of the gate oxide film 53, a higher implant dose of ions is injected into the region forming the channel of the first NMOSFET (Tr1) than into the region forming the channel of the second NMOSFET (Tr2) It is considered that by this means the threshold voltage of the first NMOSFET (Tr1) can be set to a higher value than the threshold voltage of the second NMOSFET (Tr2).

Second Embodiment

Figure 3:
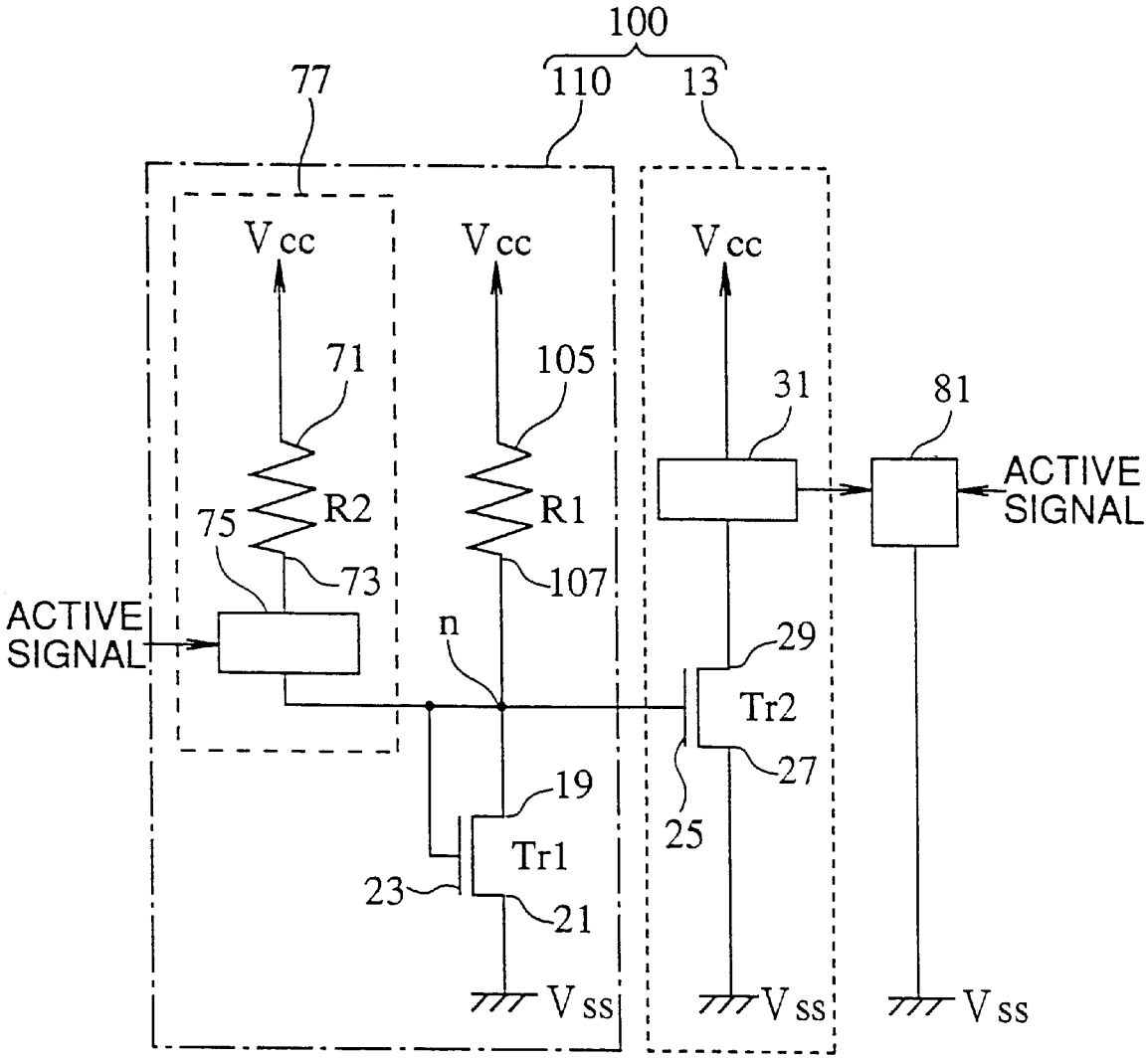
FIG. 3 is a circuit diagram schematically showing construction of a power supply circuit and for explaining a second embodiment of a power supply circuit according to this invention.

A second embodiment of this invention is now described with reference to FIG. 3, relating to an example of a power supply circuit comprising a reference voltage generating circuit and an internal voltage generating circuit, wherein the reference voltage generating circuit is provided with a reference voltage raising circuit. FIG. 3 is a schematic constructional diagram of a power supply circuit according to a second mode of implementation.

Points which differ from the first embodiment are described hereinbelow, whilst detailed explanation of points which are similar thereto is omitted.

The reference voltage generating circuit 110 for a power supply circuit 100 according to this embodiment comprises a first resistor R1, one end 105 of which is coupled to a power supply terminal Vcc, and a first NMOSFET (Tr1). In NMOSFET Tr1, the drain electrode 19 is coupled to the other end 107 of the first resistor R1, the source electrode 21 is coupled to the earth (or ground) terminal Vss, and the gate electrode 23 is coupled to the drain electrode 19. Furthermore, the reference voltage generating circuit 110 is also provided with a reference voltage raising circuit 77. This reference voltage raising circuit 77 comprises: a second resistor R2, of which one end 71 is coupled to the power supply terminal Vcc, and an electronic switch 75, coupled between the other end 73 of the second resistor R2 and the drain electrode 19 of the first NMOSFET (Tr1).

Furthermore, the internal voltage generating circuit 13 comprises: a second NMOSFET (Tr2), of which the gate electrode 25 is coupled to the drain electrode 19 of the first NMOSFET (Tr1) and the source electrode 27 is coupled to the earth terminal Vss; and a constant voltage generating circuit 31, coupled between the drain electrode 29 of the second NMOSFET (Tr2) and the power supply terminal Vcc, which outputs a constant voltage.

The output voltage from the constant voltage generating circuit 31 is the internal voltage, and this is supplied as a power supply voltage to a second (or later) stage circuit 81 connected to circuit 31. Generally, a signal known as an active signal is provided from an external source in order to drive this second stage circuit 81.

The circuit is set such that the electronic switch 75 of the reference voltage raising circuit 77 is opened and closed by this active signal.

The first and second NMOSFETs (Tr1 and Tr2) are elements manufactured by the same process, and similarly to the first embodiment, the gate length of the first NMOSFET (Tr1) is formed longer than the gate length of the second NMOSFET (Tr2) Thereby, the threshold voltage of the first NMOSFET (Tr1) is set higher than the threshold voltage of the second NMOSFET (Tr2).

The operation of the power supply circuit 100 is described hereinbelow.

Firstly, in the reference voltage generating circuit 110, when the electronic switch 75 of the reference voltage raising circuit 77 is not in an ON state, then the voltage between the power supply terminal Vcc and the earth terminal Vss is divided by the first resistor R1 and the first NMOSFET (Tr1), similarly to the power supply circuit in the first embodiment, and this divided voltage is output from output point n as the reference voltage. This reference voltage is set to virtually the same level as the threshold voltage of the first NMOSFET (Tr1).

The reference voltage is applied to the gate electrode 25 of the second NMOSFET (Tr2) of the internal voltage generating circuit 13. Since this reference voltage is higher than the threshold voltage of the second NMOSFET (Tr2), the second NMOSFET (Tr2) is switched on. Thereby, the constant voltage generating circuit 31 is actuated and a constant internal voltage is output.

This internal voltage is the power supply voltage for the second stage circuit 81, and a constant voltage is applied to this circuit 81 at all times. Since the circuit 81 is driven by an active signal, the state where the internal voltage is applied to circuit 81 becomes the so-called standby state, where it awaits input of an active signal.

When the second stage circuit 81 is operating, in other words, when an active signal is applied to the circuit 81, the electronic switch 75 of the reference voltage raising circuit 77 switches to an ON state. Thereby, in the reference voltage generating circuit 110, the voltage between the power supply terminal Vcc and the earth terminal Vss is divided by the composite resistor comprising the first resistor R1 of the reference voltage generating circuit 110 and the second resistor R2 of the reference voltage raising circuit 77 connected mutually in parallel, and the first NMOSFET (Tr1). Since the resistance value of the composite resistor formed by the first resistor R1 and the second resistor R2 is less than that of the first resistor R1, the divided voltage obtained is higher than the threshold voltage of the first NMOSFET (Tr1).

This voltage is output as the reference voltage and applied to the gate electrode 25 of the second NMOSFET (Tr2) of the internal voltage generating circuit 13.

When a large current flows in the circuit 81 connected as a second stage to the power supply circuit 100, by means of an active signal being input, the voltage between the gate electrode 25 of the second NMOSFET (Tr2) of the power supply circuit 100 and the earth terminal Vss rises temporarily, and there is a risk that the threshold voltage of the second NMOSFET (Tr2) may increase. However, since the reference voltage can be raised when the second stage circuit 81 is operated, as described previously, then even if the threshold voltage of the second NMOSFET (Tr2) rises, a voltage above this threshold voltage can be applied to the gate electrode 25 of the second NMOSFET (Tr2). Therefore, a stable internal voltage can be supplied at all times from the power supply circuit 100.

Furthermore, since the reference voltage of the power supply circuit 100 is only raised when the second stage circuit 81 is operated, the power consumption of the reference voltage generating circuit 110 is not liable to increase significantly.

Moreover, since the threshold voltage of the first NMOSFET (Tr1) is previously set to a higher value than the threshold voltage of the second NMOSFET (Tr2), then even if there is some variation in the manufacturing process, a stable internal voltage can still be supplied.

As the foregoing description reveals, in a power supply circuit comprising a reference voltage generating circuit and an internal voltage generating circuit, the gate length of the first NMOSFET, which is provided in the reference voltage generating circuit, is formed longer than the gate length of the second NMOSFET, which is provided in the internal voltage generating circuit.

Thereby, it is possible to supply a stable internal voltage, without increasing the power consumption of the reference voltage generating circuit.

Moreover, a reference voltage raising circuit comprising a second resistor is also provided in the reference voltage generating circuit. This reference voltage generating circuit is switched on when the circuit connected as a second stage to the power supply circuit is driven. Thereby, a resistor is formed by the parallel connection of the first resistor in the reference voltage generating circuit and the second resistor in the reference voltage raising circuit. Since the value of this composite resistor is less than the value of the first resistor, it is possible to raise temporarily the reference voltage output from the reference voltage generating circuit and applied to the second NMOSFET of the internal voltage generating circuit. By this means, a stable internal voltage can be supplied even when a second stage circuit carrying a large current is driven.

Consequently, in a power supply circuit comprising a reference voltage generating circuit provided with a reference voltage raising circuit, and an internal voltage generating circuit, by setting the gate length of the first NMOSFET in the reference voltage generating circuit longer than the gate length of the second NMOSFET in the internal voltage generating circuit, it is possible to supply a stable internal voltage, even when a circuit which is connected as a second stage to the power supply circuit and takes the internal voltage as a power supply voltage is driven, without the internal voltage supply becoming unstable due to manufacturing variations in the transistors.

What is claimed is:

1. A power supply circuit, comprising:

a reference voltage generating circuit; and an internal voltage generating circuit, wherein said reference voltage generating circuit comprises a resistor, of which one end is coupled to a power supply terminal and a first N-type field effect transistor, of which a drain electrode is coupled to the other end of said resistor, a source electrode is coupled to an earth terminal, and a gate electrode is coupled to said drain electrode;

wherein said internal voltage generating circuit comprises a second N-type field effect transistor, of which a gate electrode is coupled to the drain electrode of said first N-type field effect transistor and a source electrode is coupled to said earth terminal, and a constant voltage generating circuit for outputting a constant voltage, coupled between the drain electrode of said second N-type field effect transistor and said power supply terminal; and wherein further the length of said gate electrode of said first N-type field effect transistor is longer than the length of said gate electrode of said second N-type field effect transistor.

2. The power supply circuit according to claim 1, wherein said first and second N-type field effect transistors are fabricated by a same manufacturing process.

3. The power supply circuit according to claim 1, wherein the lengths of said gate electrodes of said first and second N-type field effect transistors equal 3 $\mu$m or less, respectively.

4. A power supply circuit, comprising:

a reference voltage generating circuit; and an internal voltage generating circuit, wherein said reference voltage generating circuit comprises a first resistor, of which one end is coupled to a power supply terminal and a first N-type field effect transistor, of which a drain electrode is coupled to the other end of said first resistor, a source electrode is coupled to an earth terminal, and a gate electrode is coupled to said drain electrode;

wherein said internal voltage generating circuit comprises a second N-type field effect transistor, of which a gate electrode is coupled to the drain electrode of said first N-type field effect transistor and a source electrode is coupled to said earth terminal, and a constant voltage generating circuit for outputting a constant voltage, coupled between the drain electrode of said second N-type field effect transistor and said power supply terminal;

wherein said constant voltage output by said constant voltage generating circuit is an output voltage supplied as a power supply voltage to second stage circuits driven by an active signal; and wherein further said reference voltage generating circuit is provided with a reference voltage raising circuit comprising a second resistor, of which one end is coupled to said power supply terminal, and an electronic switch, coupled between the other end of said second resistor and the drain electrode of said first N-type field effect transistor, which is opened and closed by said active signal.

5. The power supply circuit according to claim 4, wherein said first and second N-type field effect transistors are fabricated by a same manufacturing process.

6. The power supply circuit according to claim 4, wherein the length of said gate electrode of said first N-type field effect transistor is longer than the length of said gate electrode of said second N-type field effect transistor.

7. The power supply circuit according to claim 4, wherein said electronic switch is a transistor.

8. The power supply circuit according to claim 4, wherein the lengths of said gate electrodes of said first and second N-type field effect transistors equal 3 $\mu$m or less, respectively.

9. A power supply circuit, comprising:

a reference voltage generating circuit; and an internal voltage generating circuit, wherein said reference voltage generating circuit comprises a resistor, of which one end is coupled to a power supply terminal and a first N-type field effect transistor, of which a drain electrode is coupled to the other end of said resistor, a source electrode is coupled to an earth terminal, and a gate electrode is coupled to said drain electrode;

wherein said internal voltage generating circuit comprises a second N-type field effect transistor, of which a gate electrode is coupled to the drain electrode of said first N-type field effect transistor and a source electrode is coupled to said earth terminal, and a constant voltage generating circuit for generating a constant voltage, coupled between a drain electrode of said second N-type field effect transistor and said power supply terminal; and wherein further the length of said gate electrode of said first N-type field effect transistor is 0.1 $\mu$m or more longer than the length of said gate electrode of said second N-type field effect transistor.

10. The power supply circuit according to claim 9, wherein said first and second N-type field effect transistors are fabricated by a same manufacturing process.

11. The power supply circuit according to claim 9, wherein said reference voltage generating circuit includes a reference voltage raising circuit comprising a second resistor, of which one end is coupled to said power supply terminal and an electrode switch, coupled between the other end of said second resistor and the drain electrode of said first N-type field effect transistor, which is opened and closed by said active signal.

12. The power supply circuit according to claim 11, wherein said electronic switch is a transistor.

* * * * *